US006918229B2

(12) United States Patent
Lancaster, III et al.

(10) Patent No.: US 6,918,229 B2
(45) Date of Patent: Jul. 19, 2005

(54) METHOD AND APPARATUS FOR WRAPPING A LOAD

(75) Inventors: Patrick R. Lancaster, III, Louisville, KY (US); Curtis Martin, New Albany, IN (US)

(73) Assignee: Lantech.com LLC, Louisville, KY (US)

( * ) Notice: Subject to any disclaimer, the term of this patent is extended or adjusted under 35 U.S.C. 154(b) by 0 days.

(21) Appl. No.: 10/847,452

(22) Filed: May 18, 2004

(65) Prior Publication Data

US 2004/0211155 A1 Oct. 28, 2004

Related U.S. Application Data

(62) Division of application No. 10/286,748, filed on Oct. 31, 2002, now Pat. No. 6,748,718.
(60) Provisional application No. 60/330,858, filed on Nov. 1, 2001.

(51) Int. Cl.[7] ..... B65B 13/02
(52) U.S. Cl. ..... 53/399; 53/441; 53/64; 53/389.2; 226/34
(58) Field of Search ..... 53/389.2, 399, 53/226, 242

(56) References Cited

U.S. PATENT DOCUMENTS

| | | | | |
|---|---|---|---|---|
| 4,231,560 A | | 11/1980 | Stohlquist et al. | |
| 4,302,920 A | | 12/1981 | Lancaster et al. | |
| 4,503,658 A | * | 3/1985 | Mouser et al. | 53/399 |
| 4,514,955 A | | 5/1985 | Mouser et al. | |
| 4,524,568 A | | 6/1985 | Lancaster et al. | |
| 4,590,746 A | * | 5/1986 | Humphrey | 53/556 |
| 4,676,048 A | | 6/1987 | Lancaster et al. | |
| 4,768,729 A | * | 9/1988 | Jacobsson | 242/365.6 |
| 4,840,006 A | | 6/1989 | Humphrey | |
| 4,953,336 A | | 9/1990 | Lancaster, III et al. | |
| 5,054,263 A | | 10/1991 | Maki-Rahkola et al. | |
| 5,123,230 A | * | 6/1992 | Upmann | 53/465 |
| 5,311,725 A | | 5/1994 | Martin et al. | |
| 5,581,979 A | | 12/1996 | Scherer | |
| 5,836,140 A | | 11/1998 | Lancaster, III | |
| 5,884,453 A | | 3/1999 | Ramsey et al. | |
| 6,082,081 A | | 7/2000 | Mucha | |
| 6,185,914 B1 | | 2/2001 | Mackie | |

(Continued)

FOREIGN PATENT DOCUMENTS

WO WO 02/087971 11/2002

OTHER PUBLICATIONS

European Search Report for related PCT Appln. No. WO 03/037721 published May 8, 2003.

*Primary Examiner*—Stephen F. Gerrity
*Assistant Examiner*—Brian Nash
(74) *Attorney, Agent, or Firm*—Finnegan, Henderson, Farabow, Garrett & Dunner, LLP

(57) ABSTRACT

The present invention relates to an apparatus and method for stretch wrapping a load in an efficient manner so as to tightly and securely wrap the load at a desired tension without rupturing the packaging material. The method and apparatus compensate for variation in demand rate as the load is wrapped so as to apply the wrapping material to a load at a desired force, maintain the desired containment tension on the wrapping material on the load after wrapping, and prevent the wrapping material from rupturing during wrapping. The apparatus combines two systems, power assisted roller stretch ("PRS") and roller stretch ("RS") to vary the supply rate of the packaging material as the demand rate varies. The apparatus automatically switches between the two types of prestretch to achieve "high" and "low" wrapping force dependent upon the demand rate. Changes in the demand rate are sensed by monitoring changes in the payoff angle of the packaging material extending between the dispenser and the load.

17 Claims, 17 Drawing Sheets

U.S. PATENT DOCUMENTS 6,305,145 B2 * 10/2001 Suolahti ..... 53/64
6,311,920 B1 11/2001 Jennings et al.
6,360,512 B1 3/2002 Marois et al.
6,541,728 B1 * 4/2003 Baiardi et al. ..... 219/69.12

* cited by examiner

METHOD AND APPARATUS FOR WRAPPING A LOAD

DESCRIPTION OF THE INVENTION

This application is a divisional of U.S. application Ser. No. 10/286,748, filed Oct. 31, 2002, now U.S. Pat. No. 6,748,718, which claims the benefit of U.S. provisional Application No. 60/330,858, now expired, filed Nov. 1, 2001, both of which are incorporated herein by reference.

FIELD OF THE INVENTION

The present invention relates to methods and apparatus for wrapping a load with packaging material, and more particularly, stretch wrapping.

BACKGROUND OF THE INVENTION

Various packaging techniques have been used to build a load of unit products and subsequently wrap them for transportation, storage, containment and stabilization, protection and waterproofing. One system uses stretch wrapping machines to stretch, dispense and wrap stretch packaging material around a load. Stretch wrapping can be performed as an inline, automated packaging technique which dispenses and wraps packaging material in a stretch condition around a load on a pallet to cover and contain the load. Pallet stretch wrapping, whether accomplished by a turntable, rotating arm, vertical rotating ring, or horizontal rotating ring, typically covers the four vertical sides of the load with a stretchable film such as polyethylene film. In each of these arrangements, relative rotation is provided between the load and the packaging material dispenser to wrap packaging material about the sides of the load.

Stretch wrapping machines provide relative rotation between a stretch wrap packaging dispenser and a load either by driving the stretch wrap packaging dispenser around a stationary load or rotating the load on a turntable. Upon relative rotation, packaging material is wrapped on the load. Ring style stretch wrappers generally include a roll of packaging material mounted in a dispenser which rotates about the load on a ring. Wrapping rings are categorized as vertical rings or horizontal rings. Vertical rings move vertically between an upper and lower position to wrap film around a load. In a vertical ring, as in turntable and rotating wrap arm apparatuses, the four vertical sides of the load are wrapped, along the height of the load. Horizontal rings are stationary and the load moves through the ring, usually on a conveyor, as the dispenser rotates around the load to wrap packaging material around the load. In the horizontal ring, the length of the load is wrapped. As the load moves through the ring and off of the conveyor, the packaging material slides off of the conveyor (surface supporting the load) and into contact with the load.

Historically, ring style wrappers have suffered from excessive film breaks and limitations on the amount of containment force applied to the load (as determined in part by the amount of prestretch used) due to erratic speed changes required to wrap "non-square" loads, such as narrow, tall loads, short, wide loads, and short, narrow loads. The non-square shape of such loads often results in the supply of excess packaging material during the wrapping cycle, during time periods in which the demand rate for packaging material by the load is exceeded by the supply rate of the packaging material by the dispenser. This leads to loosely wrapped loads. In addition, when the demand rate for packaging material by the load is greater than the supply rate of the packaging material by the dispenser, breakage of the packaging material may occur.

When stretch wrapping a typical rectangular load, the demand for packaging material varies, decreasing as the packaging material approaches contact with a corner of the load and increasing after contact with the corner of the load. When wrapping a tall, narrow load or a short load, the variation in the demand rate is even greater than in a typical rectangular load. In vertical rings, high speed rotating arms, and turntable apparatuses, the variation is caused by a difference between the length and the width of the load. In a horizontal ring apparatus, the variation is caused by a difference between the height of the load (distance above the conveyor) and the width of the load.

The amount of force, or pull, that the packaging material exhibits on the load determines how tightly and securely the load is wrapped. Conventionally, this force is controlled by controlling the feed or supply rate of the packaging material dispensed by the packaging material dispenser with respect to the demand rate of packaging material required by the load. Efforts have been made to supply the packaging material at a constant tension or at a supply rate that increases as the demand rate increases and decreases as the demand rate decreases. However, when variations in the demand rate are large, fluctuations between the feed and demand rates result in loose packaging of the load or breakage of the packaging material during wrapping.

Prior art solutions utilize a change in the force on the packaging material to signal the need for a change in the supply rate. In response to an increase in the force acting on the film, the speed of the film payoff will be increased. In response to a decrease in the force acting on the film, the speed of the film payoff will be decreased. Reliance on sensing a change in the force on the packaging material means that a response to the need for a change in the supply rate is not initiated until after the change in demand rate has occurred. These prior art devices react to the change in the demand rate, they cannot anticipate or act simultaneously with the change. Thus, there is a lag between the time the demand rate changes and the time the supply rate changes to meet the changed demand rate. The elasticity of the packaging material can exacerbate this problem.

Due to a design preference to eliminate electrical connections to the moving ring of ring style wrappers, force sensing/reacting solutions used in other types of wrapping apparatus are not feasible. In addition, a high rate of change in film demand when wrapping non-square loads, for example, short loads, requires an immediate change in payoff speed of the packaging material in order to prevent either excess payoff or breakage. Existing force feedback systems cannot effectively react within the time frame necessary to prevent excess distribution of film or breakage.

Various spring-loaded film accumulators (also known as dancer accumulators) have been designed in an effort to resolve this problem. Such accumulators vary the supply rate to generally correspond with that of the demand rate by "taking up" excess or slack packaging material supplied during low demand periods. Such devices have met with only limited success.

Other devices, such as friction brakes and powered prestretch devices have been used to attempt to prevent excess packaging material distribution and breakage. Problems with these existing devices are discussed in the background of U.S. Pat. Nos. 4,676,048 and 4,953,336, which are incorporated herein by reference.

Friction brake systems provide a roll of film within a film carriage supported on a core shaft. The film is dispensed due to the relative rotation between the load and the packaging material dispenser, i.e., as rotation occurs, the film is pulled off of the roll to be wrapped around the load. Thus, film dispensing is not driven, but is passive. The film is stretched by the application of a brake directly to core of the film roll as the film is dispensed. Such friction brake systems were popular due to their simplicity. However, such systems had several drawbacks. One such drawback was the change in wrap force as the roll of film changed size. That is, as the film was dispensed, the size of the film roll necessarily decreased, and at the same time, the force being applied to the load by the stretch wrap (wrap force) increased. In addition, the roll of film was part of a stretching "tug of war," and thus all of the imperfections of the film winding process (nicks, burrs, "feathering") would cause the film to break prematurely. Also, the friction brake could not accommodate acceleration and deceleration in payoff demand due to the load corners.

Film driven roller stretch devices were created to address the problems associated with friction brake systems. In film driven roller stretch devices, such as those disclosed in U.S. Pat. Nos. 4,302,920 and 4,497,159, both assigned to Lantech, Inc., and incorporated herein by reference, the packaging material is stretched between two interconnected rollers, one moving faster than the other. These rollers may be connected by friction, as disclosed in U.S. Pat. No. 4,497,159, where the two prestretch rollers are in frictional contact with one another via a cam assembly. This eliminated many of the problems associated with friction brake devices. However, in order to accommodate irregular and force sensitive loads, it was necessary to find a way to vary the wrap force of the film as it was applied to the load. This problem was addressed by the device disclosed in U.S. Pat. No. 4,302,920, where the rollers were connected via a gear/clutch assembly to allow variation in the wrap force.

In this device, the substantial changes in demand speed are transmitted directly from the load back through the packaging material to the pre-stretch device, so that the supply speed of the film moving across the downstream roller to the load changes accordingly. However, the entire force exerted between the rollers is applied to the rollers by the packaging material being wrapped around the load, and prestretch device inertia causes a phase delay or lag in supply need changes. The elasticity of the packaging material between the downstream roller and the load adds to the lag. In addition, any hole or imperfection in the packaging material causes a weakening between the load and the prestretch mechanism, and potentially resulting in breakage of the packaging material.

SUMMARY OF THE INVENTION

Accordingly, the present invention is directed to a method and apparatus for wrapping a load with packaging material which provides advantages over and obviates several problems associated with earlier methods and apparatus for supplying packaging material under tension.

According to one aspect of the invention, a method for stretch wrapping a load is provided. The method includes providing relative rotation between a load and a packaging material dispenser to wrap packaging material around the load, monitoring a payoff angle of the packaging material dispensed from the dispenser, and changing a supply rate of the packaging material in response to a change in the payoff angle.

According to another aspect of the invention, an apparatus for stretch wrapping a load is provided. The apparatus comprises a dispenser for dispensing packaging material, means for providing relative rotation between the dispenser and the load to wrap packaging material around the sides of the load, means for measuring a payoff angle, and means for changing the supply rate of the packaging material in response to changes in the payoff angle.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate one (several) embodiment(s) of the invention and together with the description, serve to explain the principles of the invention.

DESCRIPTION OF THE EMBODIMENTS

Reference will now be made in detail to the present embodiments of the invention, examples of which are illustrated in the accompanying drawings. The entire contents of U.S. Pat. No. 5,836,140, is incorporated herein by reference. Wherever possible, the same reference numbers will be used throughout the drawings to refer to the same or like parts.

The present invention relates to an apparatus and method for stretch wrapping a load in an efficient manner so as to tightly and securely wrap the load at a desired tension without rupturing the packaging material.

As used herein, the terms "film", "wrap," "wrapping material," "packaging material," and "stretch wrap" refer to a material that is wrapped around the load to unitize the load and protect the load from the elements. These terms are used interchangeably. In a preferred embodiment, stretch wrap packaging material is used. In the stretch wrapping art, stretch wrap packaging material is known to have a high yield coefficient to allow the material a large amount of stretch during wrapping. Various other packaging materials, generally not considered to be stretch wrap materials, such as netting, strapping, banding, and tape, can be used as well.

Figure 1:
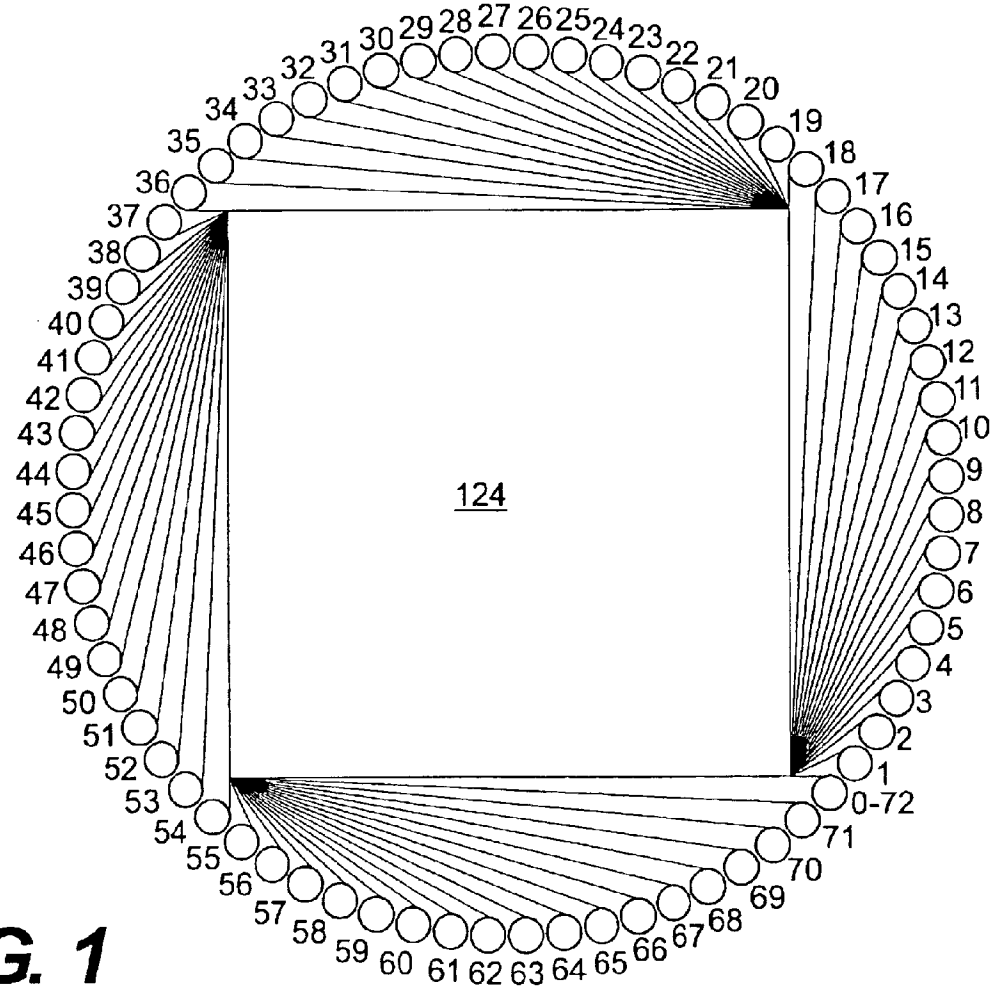
FIG. 1 is a side view of a load within a round wrapping ring, according to one aspect of the invention.

For purposes of describing the present invention, the wrapping frame may be considered as a series of points, as shown, for example, by points 0–72 in FIG. 1. As a packaging material dispenser moves around the load on the wrapping ring (between points), the amount of film that must be dispensed in order for the dispenser to reach the next point varies. In other words, the amount of film required for the dispenser to travel from point 1 to point 2 is different from the amount of film required for the dispenser to travel from point 2 to point 3, and so on.

The demand rate is the difference between the amount of packaging material needed to reach point 2 from point 1, divided by the amount of time it takes the dispenser to travel between these points. The feed rate or supply rate is the actual amount of packaging material dispensed by the dispenser as it travels from point 1 to point 2, divided by the time it takes to travel between these points. As the dispenser travels around the load, the demand rate is constantly changing. FIG. 1 shows a typical square load. As can be seen in FIGS. 2 and 3A–3F, the demand rate variation is greater for non-square load, such as a tall narrow load or a short load, than it is for a typical square load.

The present invention is directed to a method of compensating for the variation in demand rate so as to apply the wrapping material to a load at a desired force, maintain the desired containment tension on the wrapping material on the load after wrapping, and prevent the wrapping material from rupturing during wrapping. The present invention combines two supply rate control mechanisms, power assisted roller stretch ("PRS") and roller stretch ("RS") to vary the supply rate of the packaging material as the demand rate varies. PRS is disclosed in U.S. Pat. No. 4,524,568, the entire contents of which is incorporated herein by reference. PRS is a torque assistance device that provides external power assistance in prestretching and dispensing the film. For example, a hysteresis clutch linkage may be provided to the rotating ring drive to provide partial drive for prestretching the packaging material. RS is disclosed in U.S. Pat. No. 4,302,920, the entire contents of which is incorporated herein by reference. RS provides prestretching of the packaging material without any external power assistance. For this reason, RS requires a higher packaging material draw off force than does PRS to drive prestretching of the film. Thus, two prestretch systems are provided, each requiring a different amount of force to prestretch the film.

Figure 2:
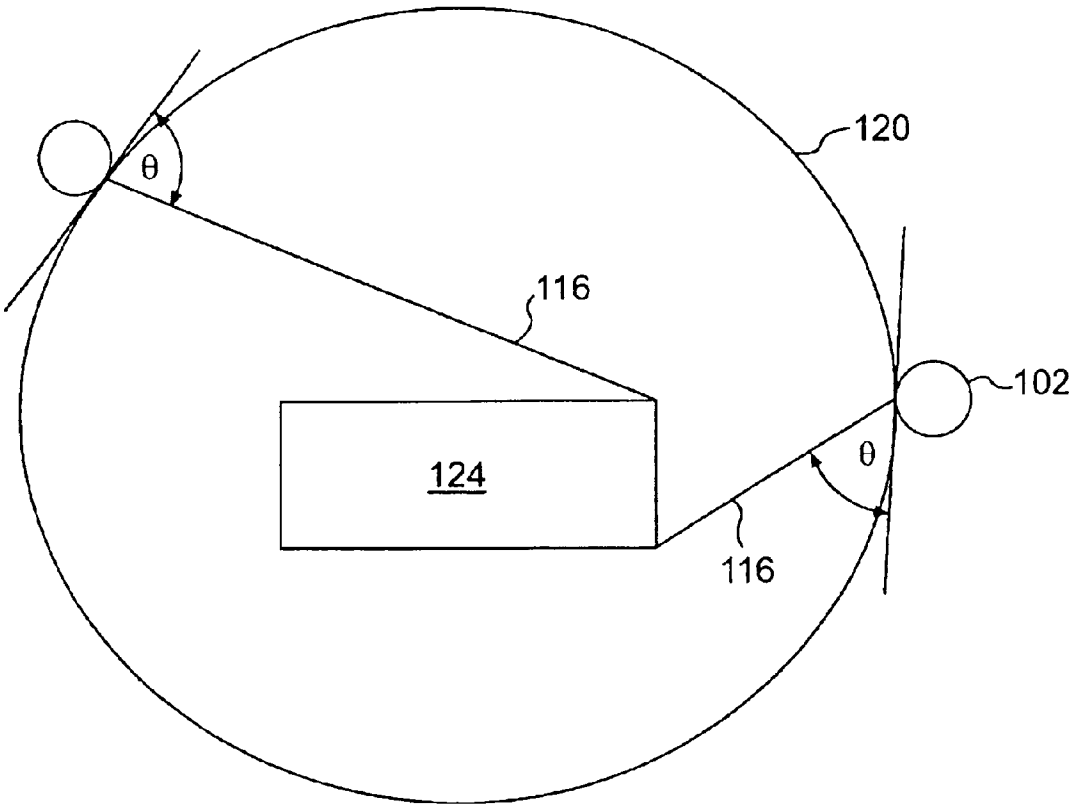
FIG. 2 is a side view of a non-square load within a round wrapping ring, indicating the payoff angle, according to one aspect of the present invention.
Figure 3A:
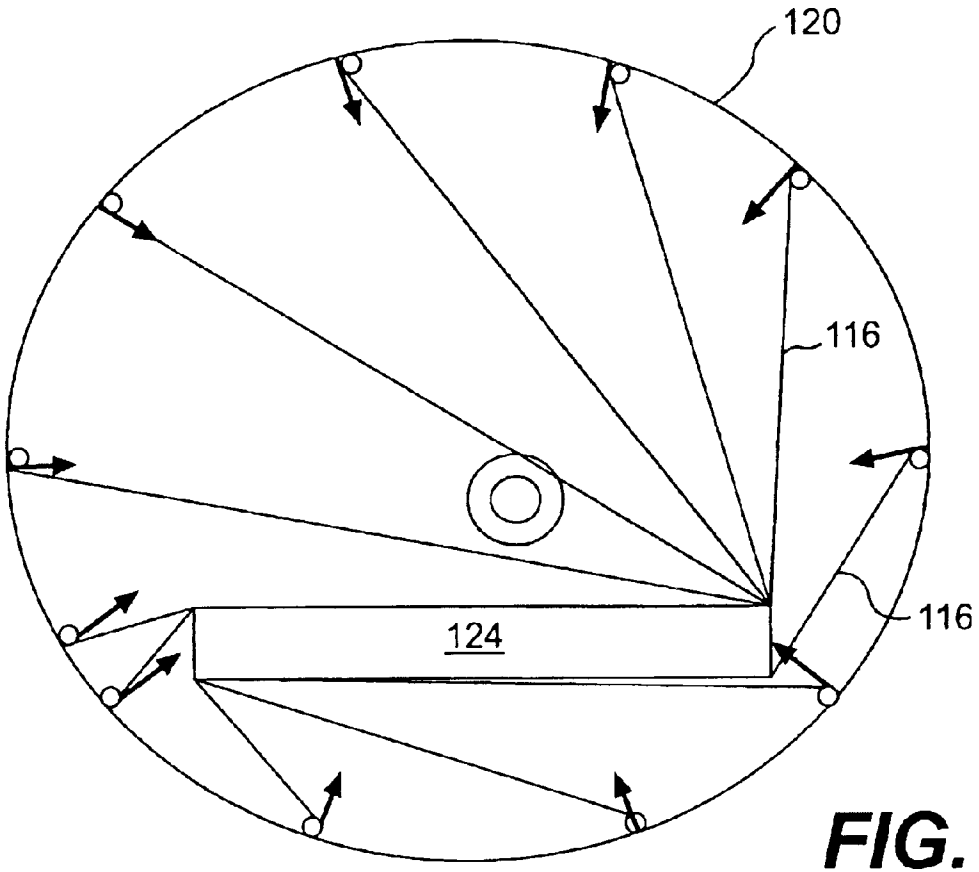
FIG. 3A is a side view of a short load within a round wrapping ring, according to an aspect of the present invention.
Figure 3B:
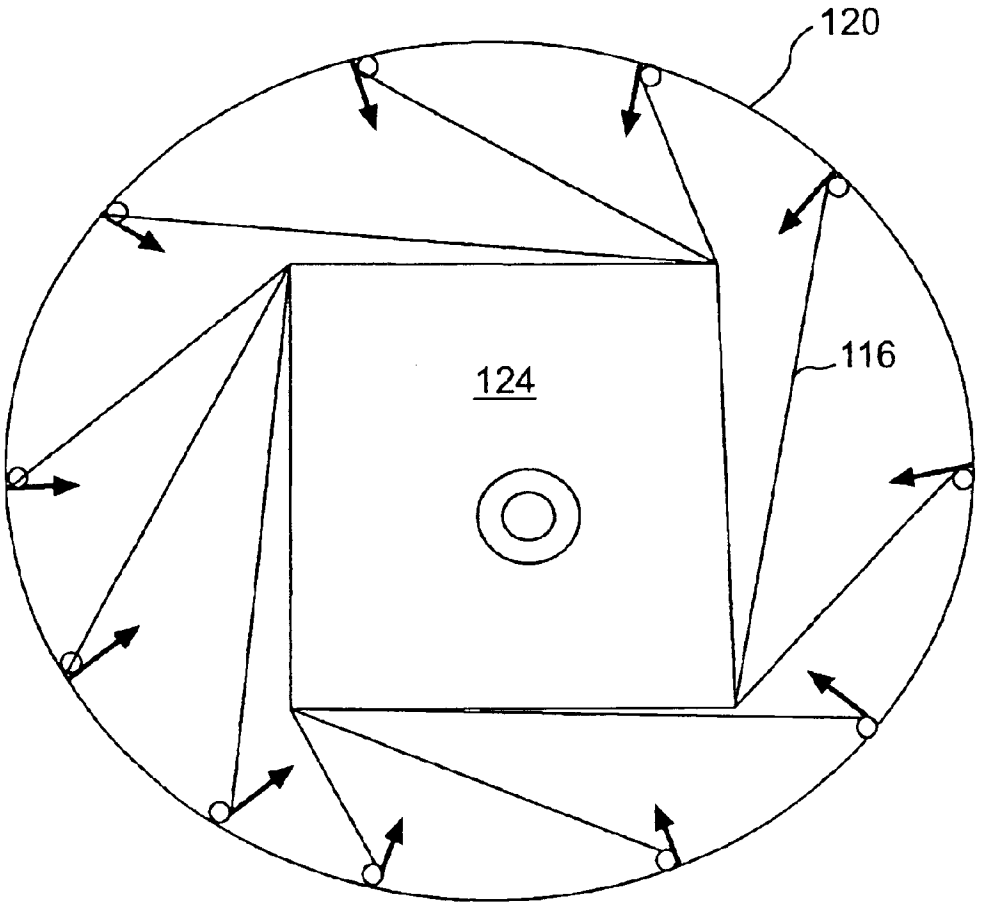
FIG. 3B is a side view of a square load within a round wrapping ring, according to an aspect of the present invention.
Figure 4B:
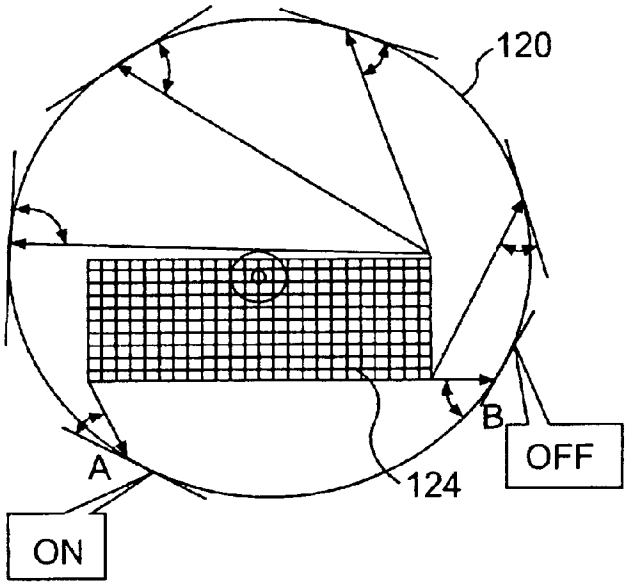
FIGS. 4A–4F are side views of various sized "non-square" loads within round wrapping rings, according to another aspect of the present invention.
Figure 4A:
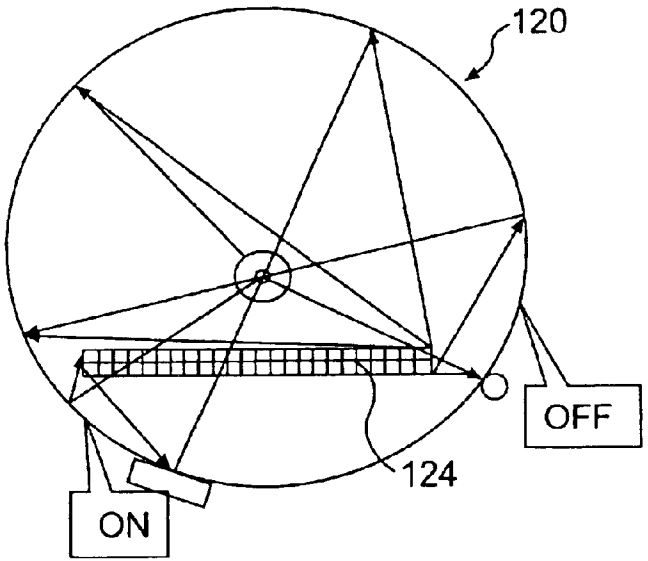
Figure 4D:
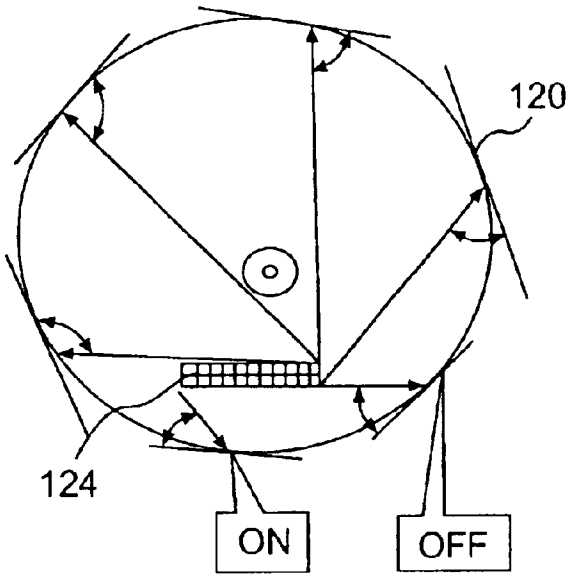
Figure 4C:
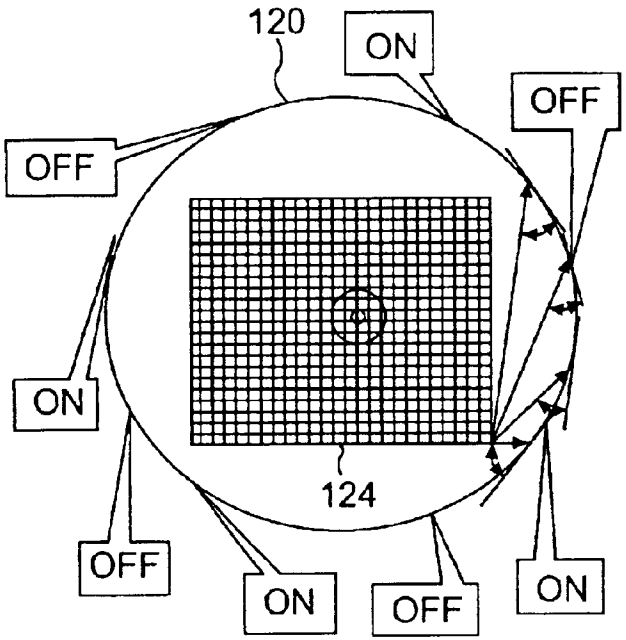
Figure 4F:
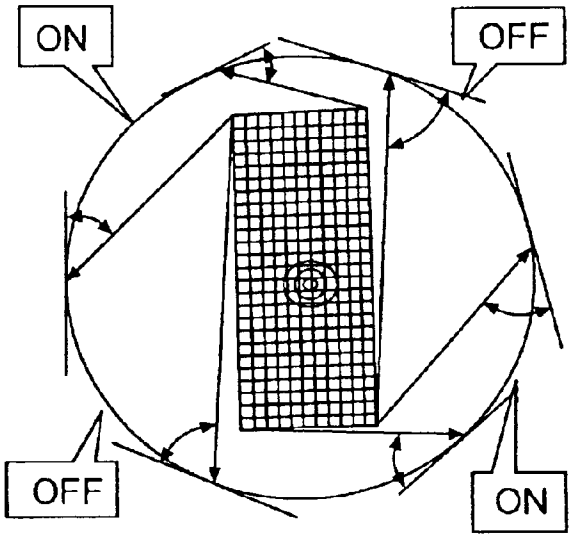
Figure 4E:
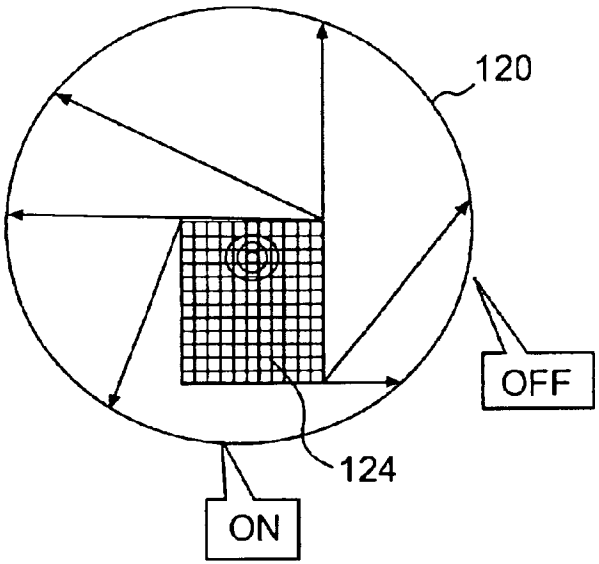

As discussed in the background of the invention, virtually all prior art devices sense a change in the force acting on the film and use the "message" that the force has changed to initiate a change in the supply rate. In contrast, the present invention senses a change in a payoff angle θ of the packaging material. As shown in FIG. 2, the payoff angle θ is the angle formed between an upstream side of a tangent to a circle of rotation where the film leaves the last roller of the packaging material dispenser and the film web as it travels to the load.

A change in the payoff angle θ signals a change in the demand rate simultaneously with or prior to the change in demand rate. Sensing a change in the payoff angle θ permits the supply rate to be changed substantially simultaneously with the change in demand rate. Thus, the change in demand rate can be anticipated, substantially eliminating the lag between the demand rate and the supply rate.

The apparatus and method of the present invention are intended to supplement the prior art, rather than replace it. Although it is possible that the present invention may be used without the prior art, it is not necessary to do so.

The present invention therefore switches between two supply rate control mechanisms based upon changes in the payoff angle θ. The first supply rate control mechanism is a torque-controlled power stretch, or PRS, as previously described. The PRS uses torque on the film to control the supply rate. The second supply rate control system reacts to an "alarm" signal based upon a change in the payoff angle θ. That is, when the payoff angle θ changes, the second supply rate control mechanism is enabled or disabled as necessary to change the supply rate. The second supply rate control system is RS, as previously described. In response to a change in payoff angle θ, the torque assistance device PRS, is either connected or disconnected, disabling or enabling RS.

As will be discussed, the present invention switches between the two supply rate control mechanisms at two predetermined values (directions) of the payoff angle θ. However, the invention is not limited to such an embodiment. The invention does not rely upon switching between the two supply rate control mechanisms at two different points. Instead, switching between the two supply rate control mechanisms may be a substantially infinitely varying process based upon minute changes in the payoff angle θ. Thus, switching could occur at four points, fourteen points, or 72 points as indicated in FIG. 1.

The present invention switches between the two supply rate control mechanisms to achieve "high" and "low" wrapping force dependent upon the demand rate as indicated by the payoff angle θ. Thus, when the demand rate decreases after a corner of the load is passed, disengagement of the torque-assistance device will enable RS, causing deceleration in the supply rate of the packaging material due to the higher force required to pull the packaging material off of the film roll. When the demand rate increases to a point at which the amount of stretch in the packaging material is too great and/or the supply rate is too slow, the torque assistance PRS is engaged or re-engaged, increasing the supply rate of the packaging material. Switching between the high and low forces by engaging and disengaging the torque assistance device occurs as the demand rate changes, and therefore there is no lag time, resulting in a load that is tightly wrapped without breakage during the wrapping cycle.

According to one aspect of the present invention, a stretch wrapping apparatus 100 is provided. The stretch wrapping apparatus includes a film dispenser, means for providing relative rotation between the dispenser and a load, and means for sensing a change in the payoff angle.

Figure 7A:
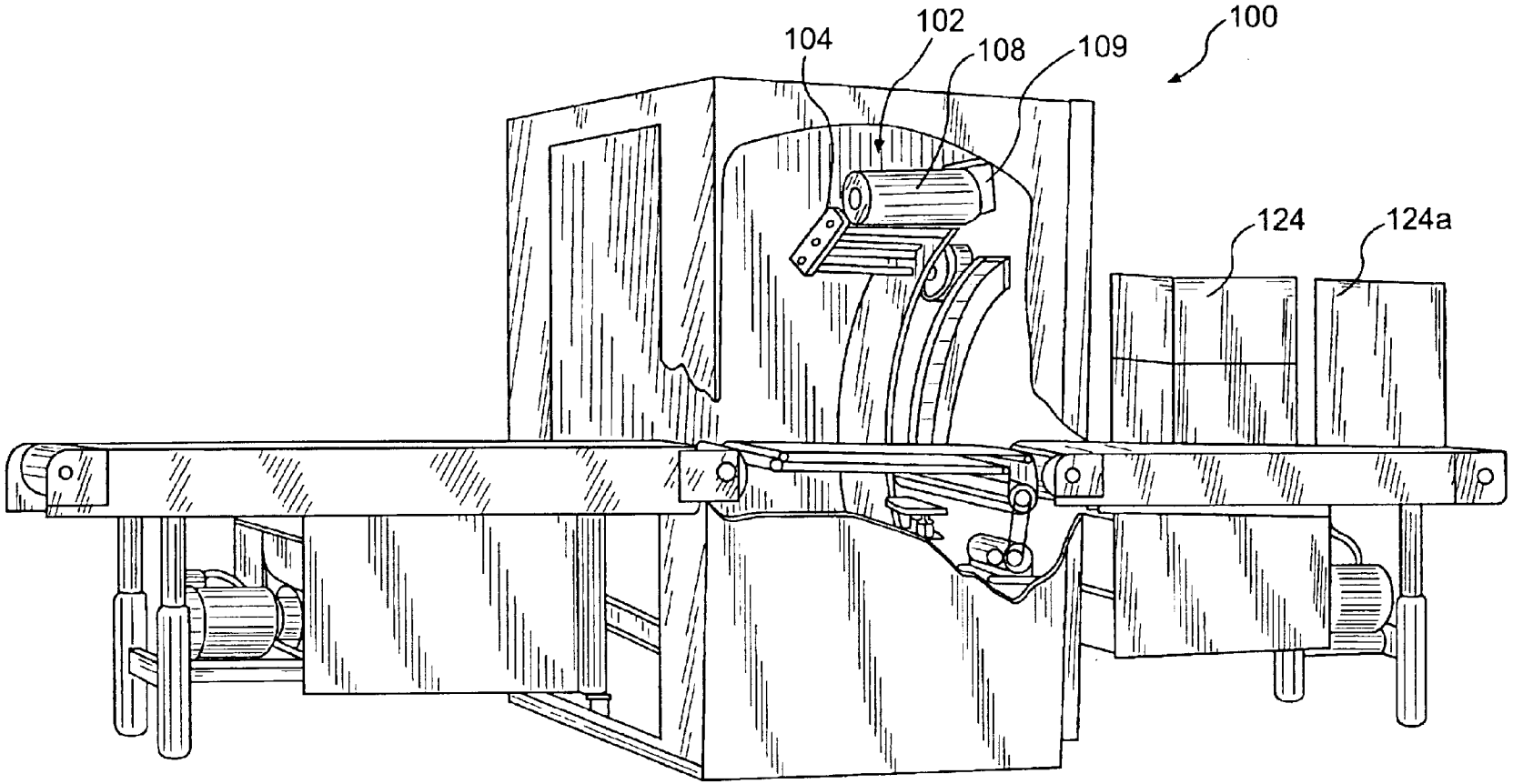
FIG. 7A is an isometric view of a wrapping apparatus including a horizontal wrapping ring, according to one aspect of the present invention.
Figure 7B:
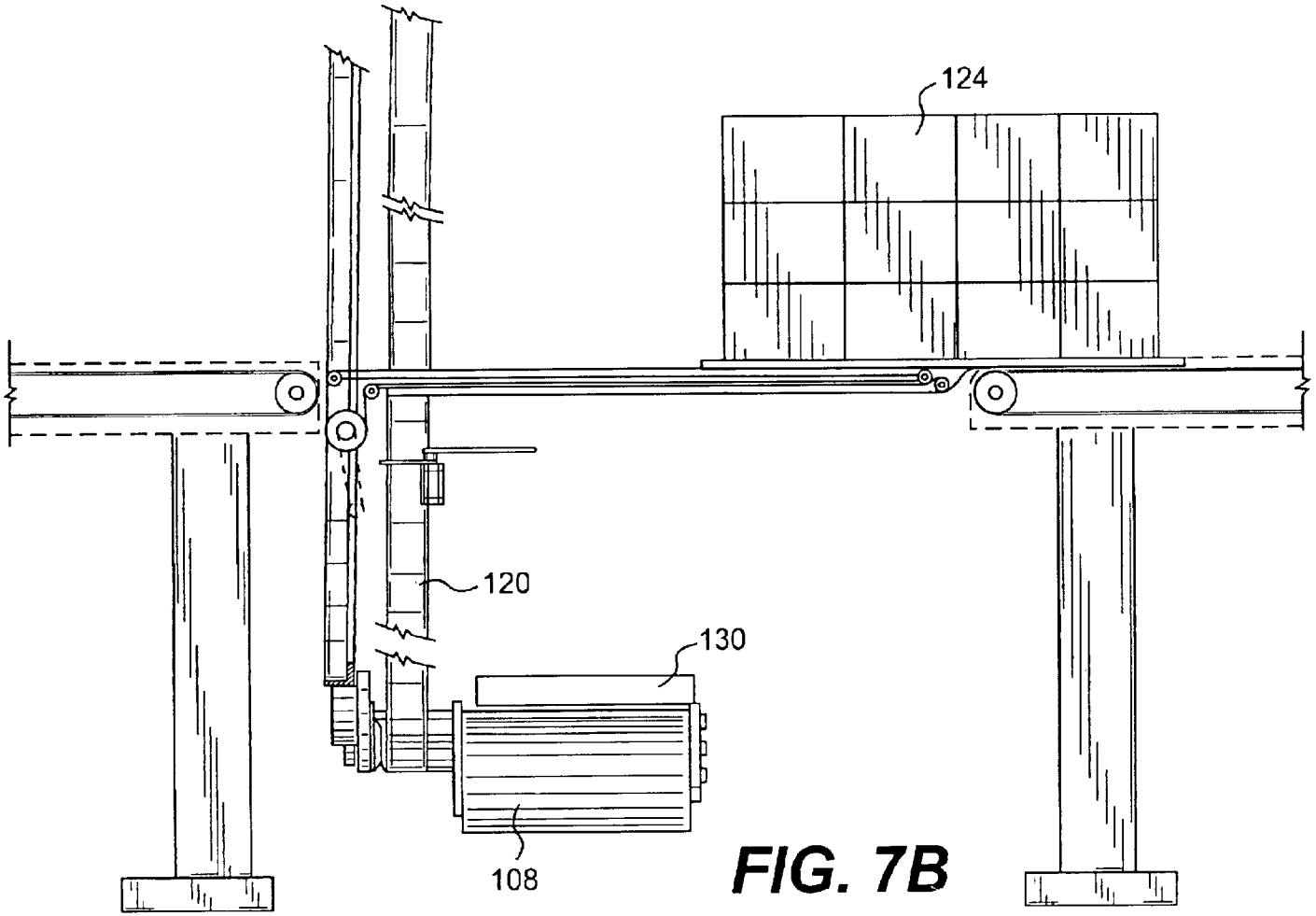
FIG. 7B is a side view of the wrapping apparatus of FIG. 7A.
Figure 7C:
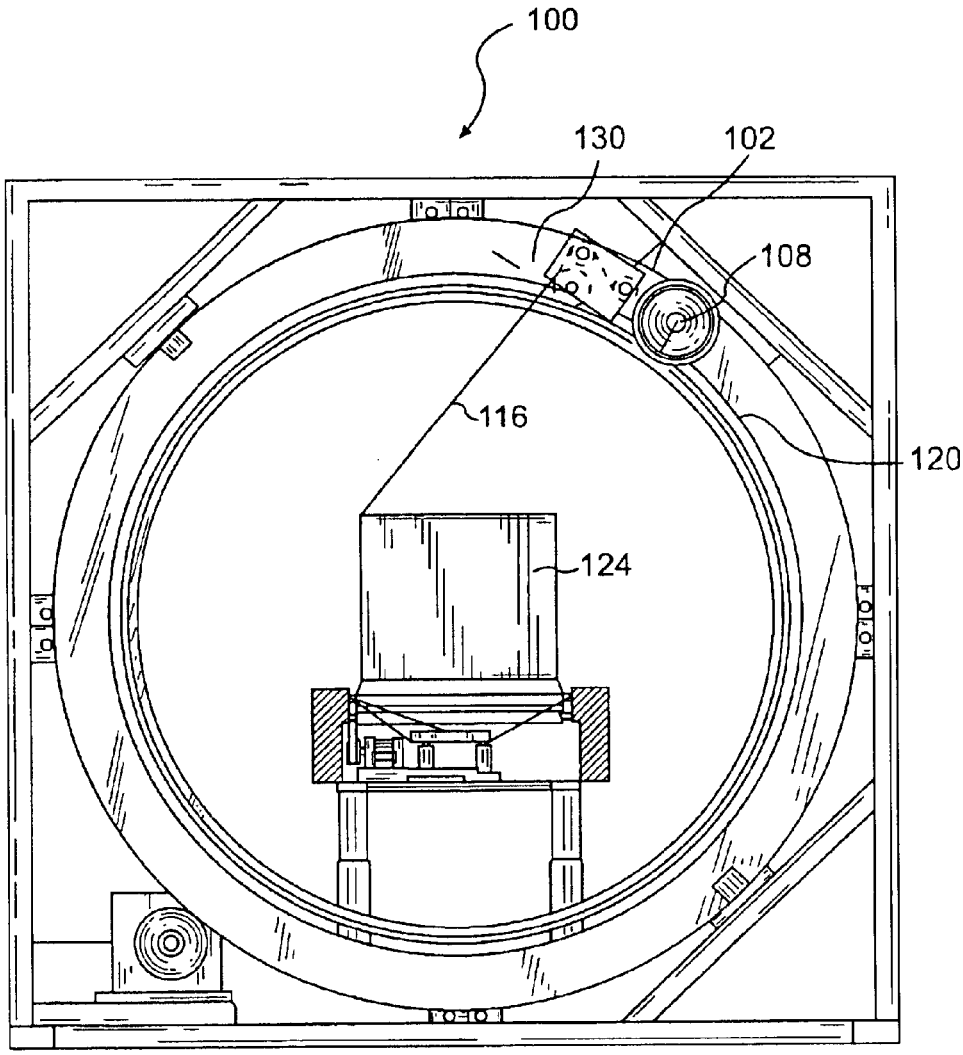
FIG. 7C is an end view of the wrapping apparatus of FIG. 7A.

As shown in FIGS. 7B and 7C, apparatus 100 includes a dispenser 102 for dispensing packaging material 116. Packaging material dispenser 102 dispenses a sheet of packaging material 116 in a web form and includes a roll carriage 109 that supports a roll of packaging material 108. Roll carriage 109 of dispenser 102 is mounted on and horizontally moveable on a horizontal wrapping ring 120, shown in FIGS. 7A–7C, to dispense packaging material 116 spirally about load 124 as rotation is provided between load 124 and dispenser 102. Alternatively, as sown in FIG. 8, an apparatus 200 may include a dispenser 202 mounted on and vertically moveable on a mast 203 to dispense packaging material 216 spirally about load 224 as rotation is provided between load 224 and dispenser 202. Additionally, the dispenser may be mounted on a rotating wrap arm (not shown) moveable around the load.

Figure 9:
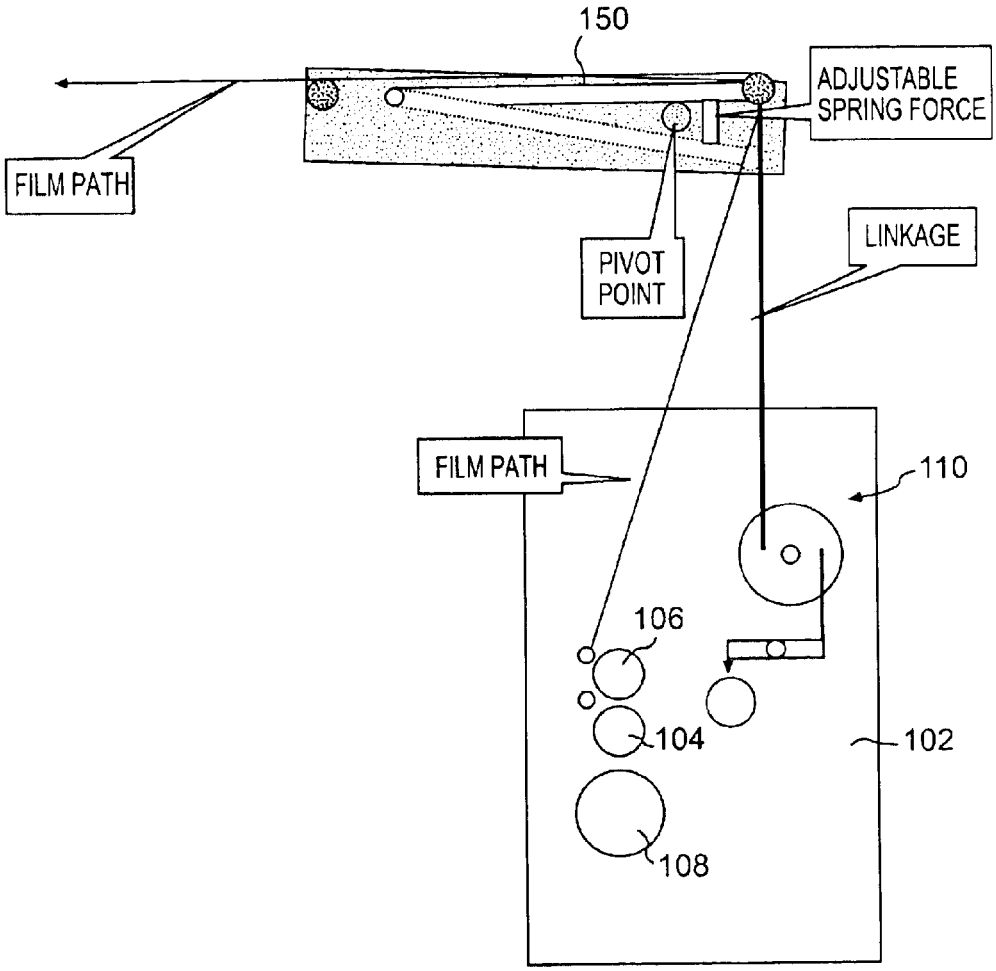
FIG. 9 is a top view of a packaging material dispenser, linkage, and payoff angle sensing device, according to one aspect of the present invention.

The dispenser 102 includes a prestretch portion and a clutch mechanism. The prestretch portion includes a first prestretch roller 104 and a second prestretch roller 106. As shown in FIG. 9, clutch mechanism 110, such as a hysteresis clutch is connected to the shaft of first prestretch roller 104. The first prestretch roller 104 is connected to second prestretch roller 106. When the clutch 110 is engaged, a drive motor (not shown) transmits power to first roller 104 to turn the prestretch rollers 104, 106, reducing the force required to pull the packaging material 116 off of roll 108 and out of the dispenser 102. When the clutch 110 is disengaged, the first and second rollers 104, 106 do not help to force the packaging material 116 out of the dispenser 102. At that point, only the rotation of the dispenser around the load pulls the packaging material 116 out of the dispenser 102. This causes the tension in the packaging material to significantly increase. Switching between the PRS and the RS is signaled by a change in the payoff angle Θ. However, the actual switching may be accomplished by any suitable mechanical or electrical means, as would be obvious to one of ordinary skill in the art.

It should also be noted that a fail-safe device may be incorporated such that, if when RS is engaged and the amount of force on the packaging material is too great, even though the payoff angle Θ does not change, the PRS is engaged.

Figure 8:
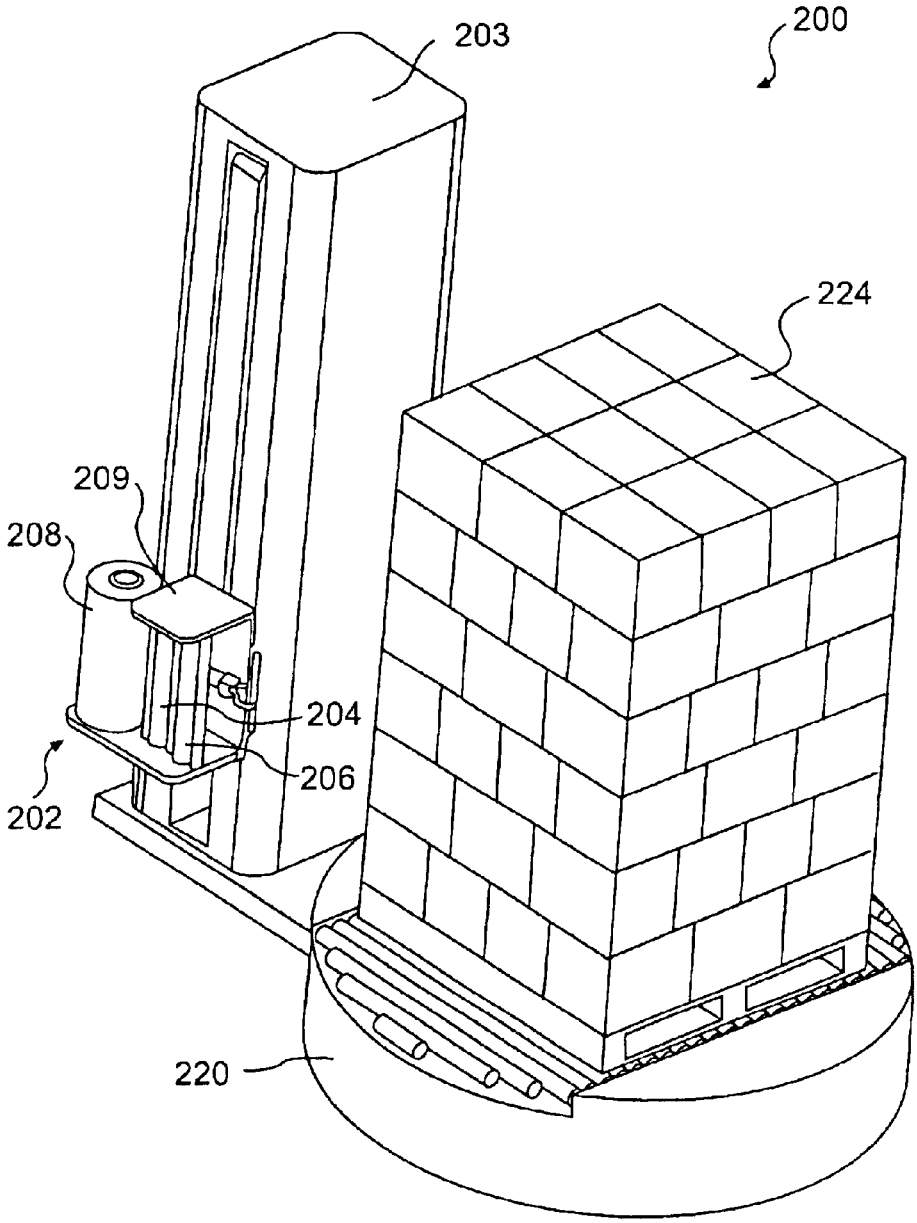
FIG. 8 is an isometric view of a wrapping apparatus including a turntable, according to another aspect of the present invention.

According to another aspect of the present invention, apparatus 100 includes means for providing relative rotation between the dispenser and the load to wrap packaging material around the load. As embodied herein and shown in FIGS. 7A–7C, the means for providing relative rotation includes a horizontal wrapping ring 120. As shown in FIGS. 7A–7C, a load 124 is carried through wrapping ring 120 on a conveyor assembly. Dispenser 102 rotates on the ring 120 and around load 124 to provide relative motion between dispenser 102 and load 124. Alternatively, as shown in FIG. 8, the means for providing relative rotation may include a conventional turntable assembly 220 having a rotatable turntable. Load 224 is rotated by the rotatable turntable of turntable assembly 220 to provide relative motion between dispenser 202 and load 224. In further embodiments (not shown) a wrapping arm or a vertical wrapping ring may provide relative rotation between the dispenser and the load.

Figure 5A:
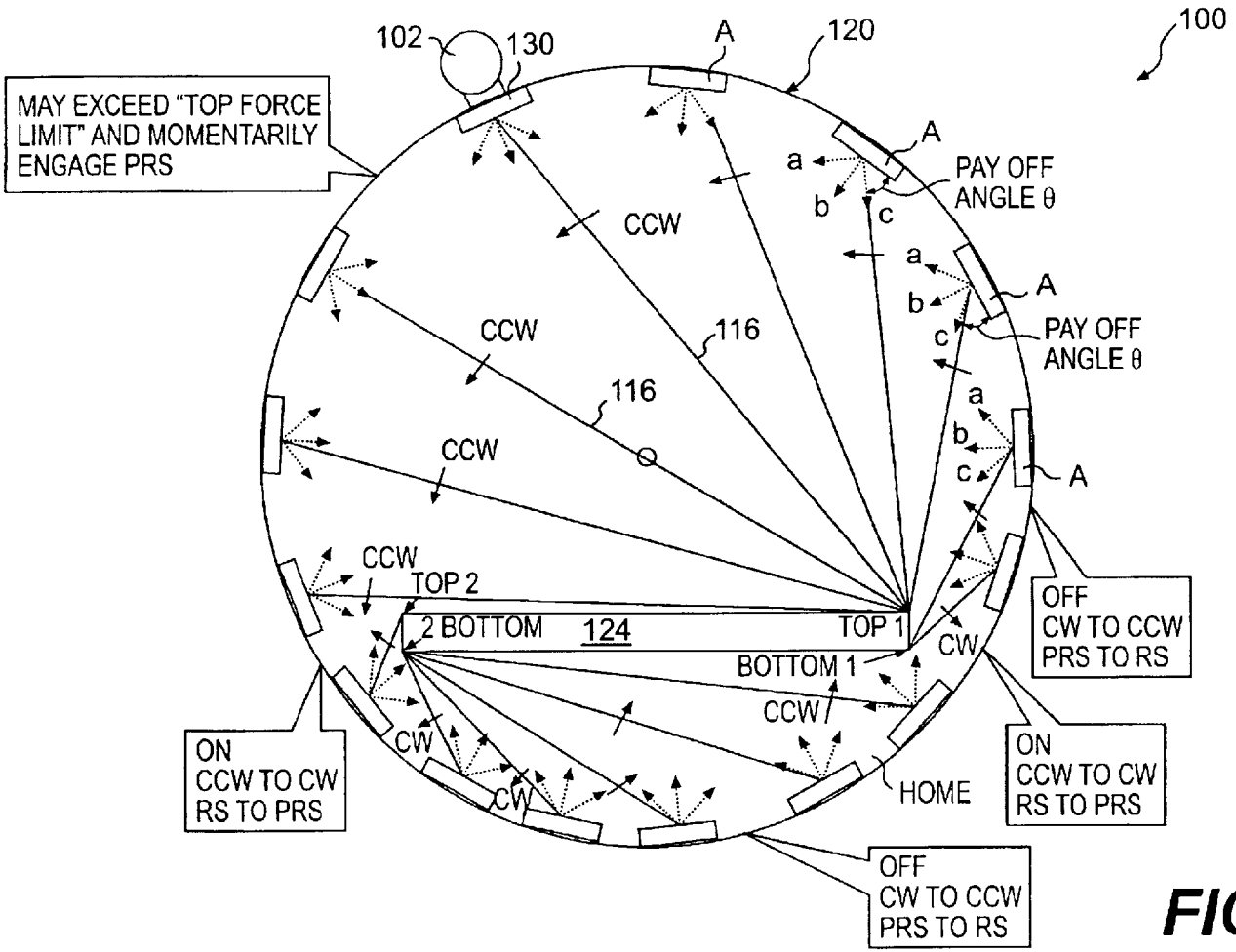
FIG. 5A is a side view of a short load showing the change in payoff angle direction at various points around the wrapping ring, according to an aspect of the present invention.

According to one aspect of the invention, means for sensing a change in the payoff angle are provided. As embodied herein and shown in FIGS. 5A, 7B, and 7C, a payoff angle measuring device 130 is attached to the dispenser 102. As shown in FIG. 2, the payoff angle θ is the angle formed between an upstream side of a tangent to a circle of rotation of the dispenser, the tangent drawn where the film leaves the last roller, and the film web as it travels to the load. The angle the packaging material is fed off of the dispenser is known, and it is always relative to a corner of the load. By observing the change in direction of the packaging material feed off with respect to a tangent of the dispenser rotation, it is possible to see that the payoff angle θ changes during rotation of the dispenser about the load. As shown in FIG. 5A, where box A represents the tangent and measuring device 130 and arrows a, b, and c are provided for reference, as the dispenser 102 moves from the "home" position to rotate around the ring 120, the payoff angle θ moves counterclockwise (direction indicated by arrow through packaging material web 116). It has been observed by the inventors that the counterclockwise movement of the payoff angle θ corresponds to a decrease in need for aid to decelerate payout of packaging material 116. As can also be observed in FIG. 5A, as the dispenser 102 rounds the second top corner of the load 124, the payoff angle θ moves clockwise (direction indicated by arrow through packaging material web 116). It has been observed by the inventors that the clockwise movement of the payoff angle θ corresponds to an increase in aid to accelerate payout of the packaging material 116.

Payoff angle measuring device 130 is represented by a box in the drawings. The measuring device 130 may be mechanical or electrical in nature. Examples of a suitable measuring device 130 include rollers positioned on either side of the packaging material where the packaging material exits dispenser 102, a spring loaded device that rides on the packaging material, or a photoarray, using laser, sonic, or light reflecting elements, to detect or sense a change in payoff angle θ. Preferably, the measuring device 130 is light weight so as to reduce the mass to be carried by the dispenser 102, although the measuring device 130 is preferably mounted on the dispenser 102, in certain embodiments it may be desirable to mount the device on the wrapping ring. An example of such an embodiment includes the use of a plurality of photosensors as the measuring device.

The payoff angle measuring device 130 preferably is mechanically linked to the clutch mechanism 110. Movement of the measuring device 130 in one direction, releases the clutch 110, disengaging PRS and enabling RS. Movement of the measuring device 130 in an opposite direction re-engages the PRS. When the measuring device 130 senses that the payoff angle θ is moving counterclockwise ("CCW"), indicating a decrease in the demand rate, it disengages the PRS, engaging RS thereby decreasing the supply rate of the packaging material 116. When the measuring device 130 senses clockwise rotation ("CW") of the payoff angle θ, indicating an increase in the demand rate, it engages the clutch 110, thereby enabling PRS and effectively increasing the supply rate of the packaging material 116.

Figure 5B:
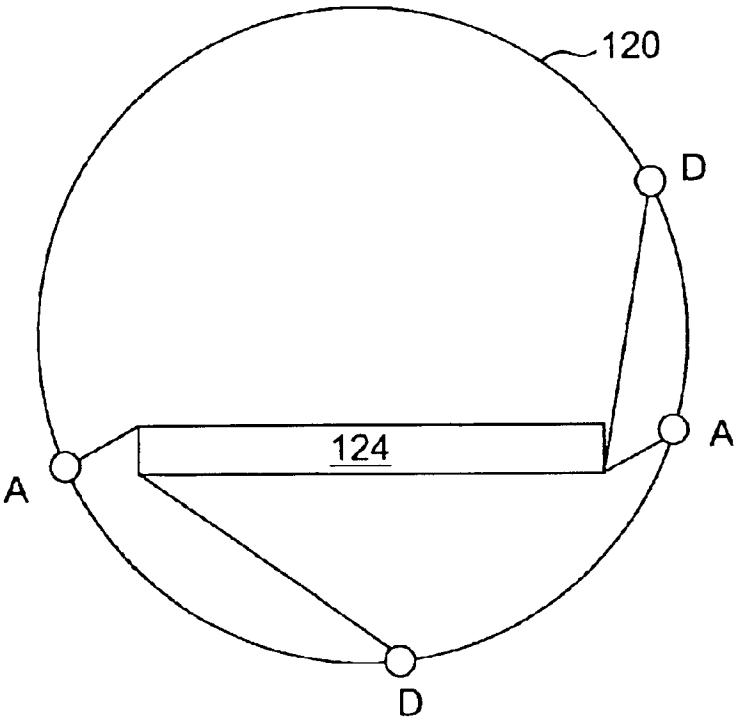
FIG. 5B is a side view of a short load showing points on the wrapping ring where the payoff angle reverses direction, according to an aspect of the present invention.
Figure 5C:
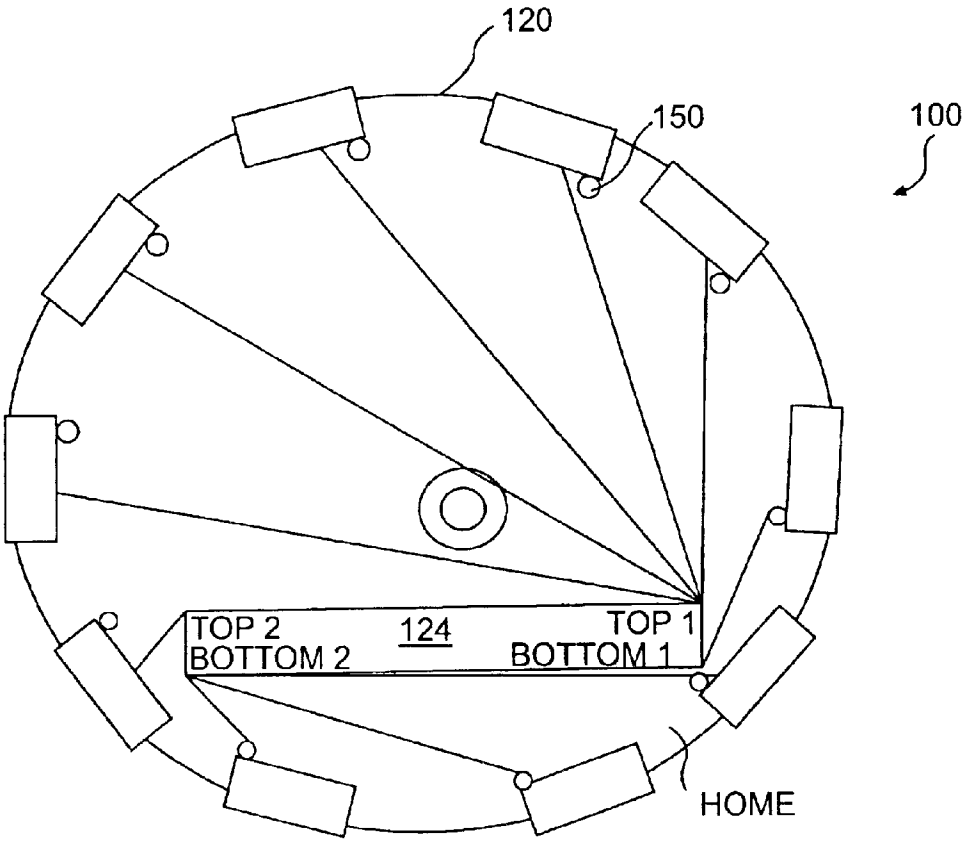
FIG. 5C is a side view of a short load showing the movement of the packaging material away from a "normal wrap position" as the dispenser moves around the wrapping ring, according to an aspect of the present invention.
Figure 6A:
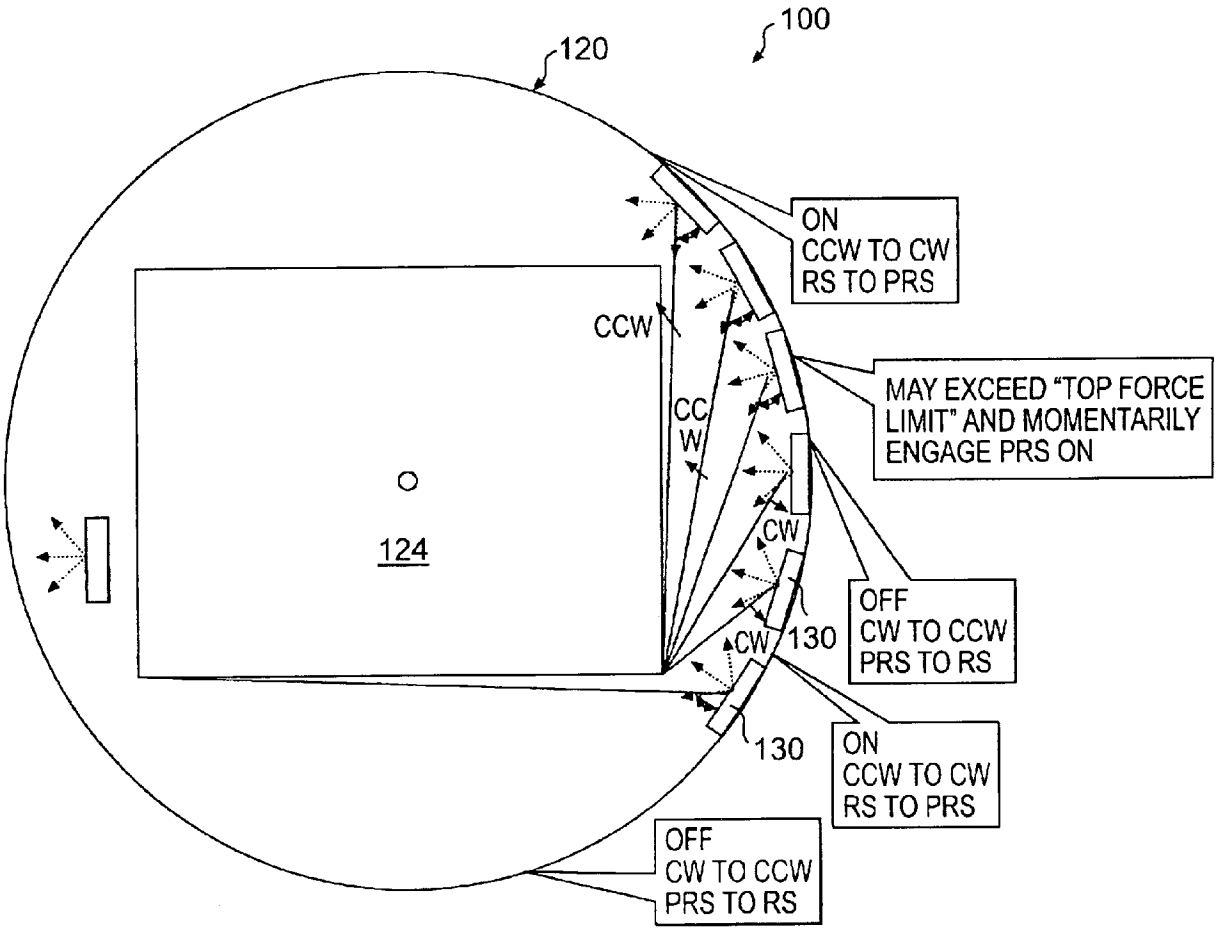
FIG. 6A is a side view of a square load showing the change in payoff angle direction at various points around the wrapping ring, according to an aspect of the present invention.
Figure 6B:
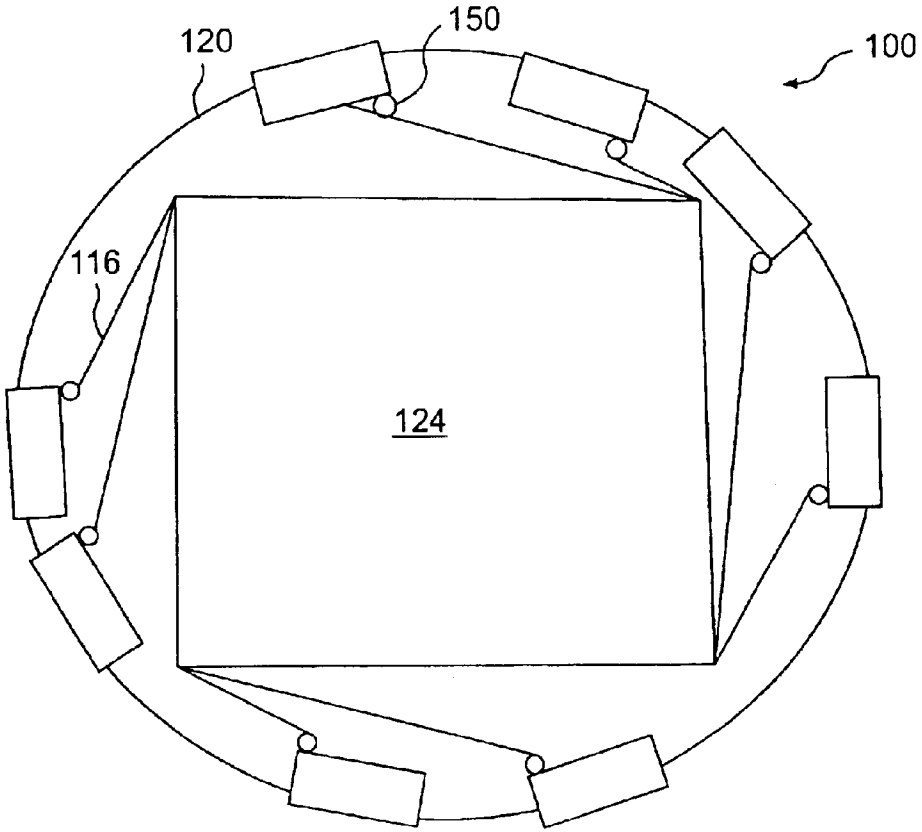
FIG. 6B is a side view of a square load showing the movement of the packaging material as the dispenser moves around the wrapping ring, according to an aspect of the present invention.

Alternatively, instead of measuring the change in direction of the payoff angle θ, it is possible to provide a simple on/off switch to enable a change between PRS and RS. In such an embodiment, the power source for the PRS is disengaged when the payoff angle θ moves from a "normal wrap position" to a "special wrap position." Thus, only loads which are not a "normal" load, such as short or tall loads, will generate sufficient force to trip the on/off switch 150. Preferably, as shown in FIG. 5C, the on/off switch 150 is a lever that is actuated by movement of the packaging material 116 against the lever. FIG. 5B shows the points in the rotation where the lever will be engaged, where letter "A" represents acceleration and indicates that PRS is engaged and the letter "D" represents deceleration and indicates that PRS is disengaged. FIGS. 6A and 6B show wrapping of a "normal" or square load.

In use, as shown in FIG. 5A, a load 124 is moved into the wrapping ring 120 on a conveyor and the dispenser 102 begins to rotate around the ring 120 to dispense packaging material 116. As the dispenser 102 leaves the home position, the payoff angle θ is CCW, and PRS is off. As the dispenser 102 moves around bottom corner 1 of the load 124, the payoff angle θ changes to CW, engaging PRS. Once the dispenser 102 is above top corner 1 of the load, the payoff angle θ changes direction again to CCW, indicating a decrease in the demand rate and PRS is disengaged, enabling RS. RS remains on until the payoff angle θ again changes direction to CW (between top corner 2 and bottom corner 2 of the load), indicating an increase in the demand rate. PRS is engaged until the final change in direction of the payoff angle θ, right before the dispenser 102 reaches the home position, where the PRS is once again disengaged. It should be noted that the actual point where the payoff angle θ changes direction from CCW to CW and CW to CCW are case sensitive, dependent upon the size and shape of each load being wrapped. This is illustrated in FIGS. 4A–4F.

If an on/off 150 switch is used instead of a payoff angle measuring device 130, the method of operation is as follows. As the dispenser 102 leaves the home position, the payoff angle θ is such that the packaging material 116 holds switch 150 in the "normal wrap position" and PRS is engaged. After the dispenser 102 has passed bottom corner 1 and top corner 1 of the load 124, the payoff angle θ changes such that packaging material 116 moves off switch 150, causing PRS to be disengaged. Therefore, RS is enabled. RS remains enabled until the dispenser 102 has passed top corner 2 and bottom corner 2 of the load 124. At that time, the payoff angle θ again changes such that packaging material 116 moves back onto switch 150 and PRS is once again engaged. It should be noted that the actual point where the packaging material moves off of and back onto the switch (i.e., "normal wrap position") are case sensitive, dependent upon the size and shape of each load being wrapped. This method is illustrated in FIGS. 5A and 6B.

Although the methods and apparatus illustrated focus on a horizontal wrapping ring, the method and apparatus of the present invention are not limited to such an embodiment. The method and apparatus would function equally well with a wrapping arm, a turntable, or a vertical wrapping ring to provide the relative rotation.

Other embodiments of the invention will be apparent to those skilled in the art from considering the specification and practicing the invention disclosed herein. Other wrapping materials may be used. It is intended that the specification and examples be considered as exemplary only, with true scope and spirit of the invention being indicated by the following claims and their equivalents.

What is claim is:

1. A method of wrapping a load with packaging material, comprising:

providing relative rotation between a load and a packaging material dispenser to wrap packaging material around the load;

monitoring a payoff angle of the packaging material dispensed from the dispenser; and changing a supply rate of the packaging material in response to a change in the payoff angle.

2. The method of claim 1, wherein monitoring the payoff angle includes determining a direction of the payoff angle.

3. The method of claim 2, wherein the direction of the payoff angle is one of clockwise and counterclockwise.

4. The method of claim 3, wherein changing the supply rate includes engaging power assisted roller stretch.

5. The method of claim 3, wherein changing the supply rate includes disengaging power assisted roller stretch.

6. The method of claim 1, wherein providing relative rotation includes rotating the dispenser around a horizontal wrapping ring.

7. The method of claim 1, wherein providing relative rotation includes rotating the dispenser around a vertical wrapping ring.

8. The method of claim 1, wherein providing relative rotation includes rotating the dispenser on a high speed wrapping arm around the load.

9. The method of claim 1, wherein providing relative rotation includes rotating the load on a turntable.

10. The method of claim 1, wherein monitoring the payoff angle includes signaling an increase in the payoff angle.

11. The method of claim 1, wherein monitoring the payoff angle includes signaling a decrease in the payoff angle.

12. The method of claim 1, wherein changing the supply rate includes decoupling a clutch mechanism when the payoff angle increases.

13. The method of claim 1, wherein changing the supply rate includes coupling a clutch mechanism when the payoff angle decreases.

14. The method of claim 1, wherein monitoring the payoff angle includes mechanically monitoring the payoff angle.

15. The method of claim 1, wherein monitoring the payoff angle includes electrically monitoring the payoff angle.

16. A method of wrapping a load with packaging material, comprising:

providing relative rotation between a load and a packaging material dispenser to wrap packaging material around the load;

monitoring a payoff angle of the packaging material dispensed from the dispenser; and changing a supply rate of the packaging material in response to a change in the payoff angle, wherein changing the supply rate includes mechanically switching between two supply rate control mechanisms.

17. A method of wrapping a load with packaging material, comprising:

providing relative rotation between a load and a packaging material dispenser to wrap packaging material around the load;

monitoring a payoff angle of the packaging material dispensed from the dispenser; and changing a supply rate of the packaging material in response to a change in the payoff angle, wherein changing the supply rate includes electronically switching between two supply rate control mechanisms.

* * * * *